United States Patent [19]

White et al.

[11] 4,376,343

[45] Mar. 15, 1983

[54] METHOD AND APPARATUS FOR DRYING BAGASSE

[76] Inventors: Henry J. White, P.O. Box 215; Bradford W. Eaves, P.O. Box 220, both of Pa'auhau, Hi. 96775

[21] Appl. No.: 285,574

[22] Filed: Jul. 21, 1981

[51] Int. Cl.[3] ..... F26B 11/02; F23G 5/02

[52] U.S. Cl. ..... 34/109; 34/128; 34/136; 110/224; 110/226; 110/227; 432/112; 432/107

[58] Field of Search ..... 34/108, 109, 128, 136, 34/139; 110/341, 346, 218, 219, 221, 224, 226, 227, 246; 432/112, 113, 107

[56] References Cited

U.S. PATENT DOCUMENTS

| | | | |
|---|---|---|---|
| 635,260 | 10/1899 | Larsen | 110/226 |
| 2,213,667 | 9/1940 | Dundas et al. | 110/220 |
| 2,301,922 | 11/1942 | Atti | 34/128 |
| 4,154,574 | 5/1979 | Keirle et al. | 34/128 |
| 4,217,878 | 8/1980 | Wieweck | 126/121 |
| 4,274,342 | 6/1981 | Nider | 110/246 |
| 4,285,773 | 8/1981 | Taciuk | 34/128 |
| 4,326,470 | 4/1982 | Maranhao | 110/224 |

*Primary Examiner*—Henry C. Yuen

*Attorney, Agent, or Firm*—Francis B. Francois; Francis D. Thomas, Jr.

[57] ABSTRACT

An outer cylindrical drum has an inner drum concentrically mounted therein in spaced relationship, to form coextensive outer and inner drying chambers that are connected to a common source of hot exhaust gases from a sugar factory boiler. Raw bagasse is first passed through the outer annular chamber to effect primary drying thereof, and then a portion of the primary dried bagasse is divided from the remainder and is passed through the inner chamber to produce secondary dried bagasse. The conveyance path between the point where the primary bagasse is divided and the inlet of the inner chamber is short in both time and distance to preserve heat in the divided portion, and an entrainment unit is utilized to preheat the divided portion before it enters the inner chamber.

10 Claims, 2 Drawing Figures

METHOD AND APPARATUS FOR DRYING BAGASSE

TECHNICAL FIELD OF THE INVENTION

This invention relates generally to a method and apparatus for drying bagasse, which is the plant material remaining after the sugar has been pressed from sugar cane. More particularly, it relates to a novel method and apparatus for efficiently utilizing hot exhaust gases to produce primary and secondary dried bagasse, with the latter being suitable for pelletizing into a fuel.

BACKGROUND OF THE INVENTION

After sugar cane has been cut and pressed at the mill to remove sugar, the crushed plant stalk material that remains is called bagasse. Typically, the raw bagasse consists of about 48% fiber, 50% moisture and 2% of soluble matter such as residual sugar and other organic and inorganic substances. Once regarded as a waste material, bagasse is now being looked to as a source of energy to operate plant boilers and the like. However, in its raw form the bagasse is a low-grade fuel that requires large furnaces because of the large volume of flue gases produced, and typically it will have a heat content of 2,005–2,340 kilocalories per kilogram. While useful, the raw bagasse is thus not an especially desirable fuel.

It has been found, however, that if the moisture content of the raw bagasse is lowered, its desirability as a fuel can be greatly increased. Thus, efforts have been made to dry the raw bagasse, and commonly the hot exhaust or flue gases from the sugar factory boilers or similar sources are utilized for this purpose. In the usual arrangement, the raw bagasse is placed in a large dryer to which the hot exhaust gases are admitted, with the raw bagasse being agitated as the gases pass therethrough. This process can lower the moisture content of the raw bagasse by several percentage points, making it a more desirable fuel.

With the high cost of conventional energy, attention has recently been directed toward producing a more efficient fuel from bagasse. It has been found that if the moisture content of the raw bagasse is lowered sufficiently and if the particle size of the material is proper, the bagasse can then be pelletized to form a fuel with relatively high BTU value, compared to the raw bagasse. To achieve this, the raw bagasse first undergoes a primary or initial drying cycle done much as in the past, to produce primary dried bagasse. A portion of the primary dried bagasse is thereafter passed through a secondary drying cycle, to further lower its moisture content and produce secondary dried bagasse suitable for pelletizing.

In processing the bagasse it is still desired to utilize the hot exhaust gases to produce both primary and secondary dried bagasse for overall efficiency in the energy cycle. However, difficulties have been encountered in doing this in an efficient manner.

Part of the problem flows from the fact that the hot exhaust gases actually are relatively low in temperature, usually falling into the range of between about 375° F. and 425° F. This has required drying drums that are large in dimension, to lower the moisture content of the raw bagasse. More particularly, in the past two separate drying operations with separate equipment have been required to produce both primary dried bagasse and secondary dried bagasse, with the processing being done in a sequential manner. The equipment required occupies considerable space, is expensive, and most importantly does not utilize the hot exhaust gases in the most efficient manner.

The need thus exists for a new method and apparatus for producing primary and secondary dried bagasse, the latter being suitable for pelletizing, designed to make maximum efficient use of the energy provided by the relatively low temperature exhaust gases of a sugar factory or the like so as to maximize the overall energy cycle efficiency and minimize the need to utilize oil and other conventional fuels. The present invention is intended to satisfy that need.

BRIEF SUMMARY OF THE INVENTION

In the method of the invention, the whole batch of raw bagasse is exposed within an annular chamber formed in a first rotating cylindrical drum to a first portion of the hot exhaust gas flow from a boiler flue or the like, to produce primary dried bagasse. The primary dried bagasse is separated in the apparatus, and a portion thereof is then passed through a rotating cylindrical drum placed concentrically within the first drum and exposed to a second portion of the hot exhaust gases. The apparatus includes transfer means for transmitting the separated portion of primary dried bagasse to the second drum over a short path and in minimum time, to minimize heat loss therein. The separated portion of bagasse is normally subjected to shredding during transport, to produce particles of the correct dimensions for pelletizing.

By dividing the hot exhaust gas flow into two portions passing through concentrically arranged first and second drying drums, maximum efficiency in using the gas flow is obtained. The second drying drum is surrounded by the first, which minimizes heat loss from the more secondary drying operation. Further, the whole apparatus is relatively compact and mechanically simple. The present apparatus and method constitute a significant advance in the art of utilizing bagasse as fuel and, in particular, assure that a factory's exhaust or flue gases are utilized to the maximum in producing the primary and secondary dried bagasse.

The principal object of the present invention is to provide a method and apparatus for producing both primary and secondary dried bagasse, wherein drying is achieved by utilizing hot exhaust or flue gases in a manner to assure maximum energy efficiency.

Another object is to provide a method and apparatus for producing both primary and secondary dried bagasse, wherein the apparatus is of minimum length and diameter, and of relatively simple mechanical construction.

A further object is to provide a dryer apparatus wherein the secondary chamber is concentrically disposed with the primary chamber, and part of the product produced from the primary chamber is then passed through the secondary chamber for further drying.

Other objects and many of the attendant advantages of the present invention will become readily apparent from the following detailed description of the preferred embodiment, when taken in conjunction with the accompaning drawings.

DETAILED DESCRIPTION OF THE PREFERRED EMBODIMENT

Figure 1:
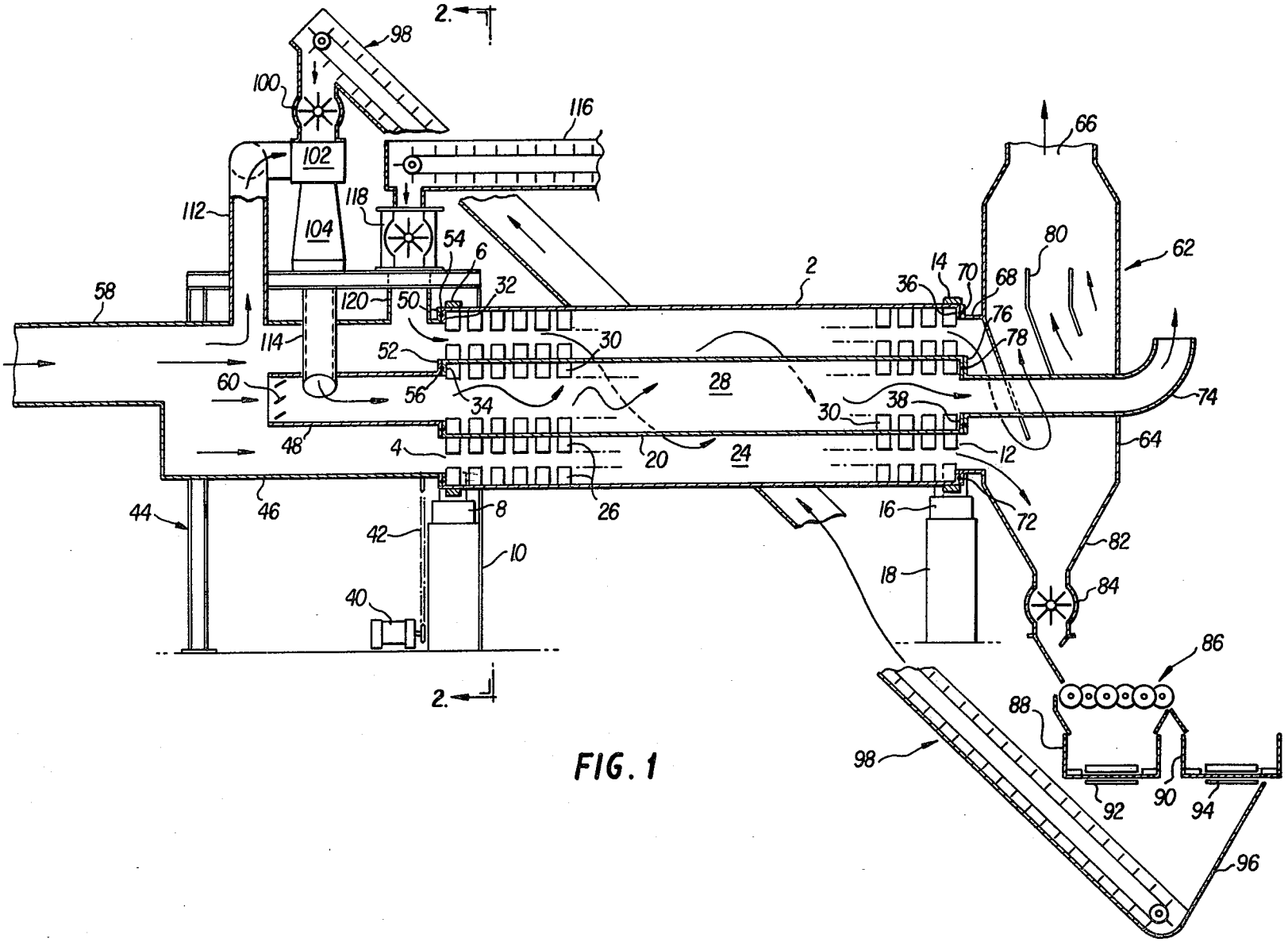
FIG. 1 is a longitudinal sectional view through the dryer apparatus of the present invention showing the components thereof in schematic form, portions of certain components being broken away for purposes of clarity.

Referring now to the drawings, an outer cylindrical drying drum is indicated at 2, the inlet end 4 thereof having thereon an annular ring 6 that rests on bearing units 8 mounted on a first support 10. The outlet end 12 of the drum 2 carries a similar annular ring 14, which rests on bearing units 16 mounted on a second support 18. Mounted concentrically within the outer drum 2 and generally coextensive therewith is an inner cylindrical drum 20, positioned to lie concentrically about the longitudinal axis of the outer drum 2 and supported from the walls thereof by radial spacers 22. The inner surface of the first or outer drum 2 and the outer surface of the second or inner drum 20 define therebetween an outer annular chamber 24, and carry thereon a plurality of fins 26 of suitable design and arrangement to help agitate raw bagasse as it passes through the chamber 24. The inner surface of the inner drum 20 defines an inner chamber 28, and carries thereon fins 30 that are similar in arrangement and purpose to the fins 26.

The inlet end 4 of the outer drying drum 2 has an inwardly directed sealing flange 32 thereon, and the inlet end of the inner drying drum 20 has a similar sealing flange 34. The outlet ends of the drums 2 and 20 are provided with similar sealing flanges 36 and 38, respectively. A motor 40 is connected by a chain or belt 42 to one of the bearing units 8 upon which the annular ring 6 rests, and functions to rotate the two concentrically arranged drying drums about the longitudinal axis thereof.

Positioned at the inlet ends of the outer and inner drying drums 2 and 20 is a vertical frame 44, which supports an outer inlet housing 46 having a shorter, smaller diameter inner inlet housing 48 mounted concentrically therein. The outlet ends of the housings 46 and 48 carry external sealing flanges 50 and 52 thereon, respectively, which are positioned to abut the flanges 32 and 34 on the rotating drying drums 2 and 20. Suitable annular sealing rings 54 and 56 are engaged between the flanges 50 and 32 and the flanges 52 and 34, respectively, whereby a rotating sealed joint results. A gas supply conduit 58 is connected with the outer inlet housing 46, and leads from the flue or exhaust of sugar factory boiler units, or the like (not shown). The inlet end of the inner inlet housing 48 has adjustable dampers 60 mounted therein, which can be adjusted to control the flow of heated gases into the housing 48 from the larger outer inlet housing 46.

Turning to the outlet end of the drying drums 2 and 20, a collector unit 62 is mounted at said end and includes a vertical collection chamber 64 having an outlet 66 at its upper end which leads to cyclone and fan apparatus (not shown) for handling the primary dried bagasse as it leaves the annular outer drying chamber 24. The fan apparatus also serves to help draw the exhaust gases through the dryer. The collection chamber 64 has an inlet portion 68 provided with an external flange 70 that is positioned to confront the flange 36 on the drum 2, and a sealing ring 72 is positioned therebetween.

A secondary dried bagasse collection conduit 74 is carried by the collection chamber 64 and passes completely through the outer wall thereof. The inner end of the conduit 74 carries an external flange 76 that confronts the flange 38, and a sealing ring 78 is positioned therebetween. The collection conduit 74 collects the secondary bagasse from the inner chamber 28 of the drying unit, and prevents it from being mixed with the primary dried bagasse.

The collection chamber 64 contains a set of vanes 80 therein, arranged to direct the flow of the primary bagasse exiting from the horizontally disposed annular drying chamber 24 in an upward direction, toward the outlet 66. As this occurs, some of the primary bagasse will drop into a hopper 82 at the bottom of the chamber 64, from which it is withdrawn through an air lock 84 and deposited on suitable screening or sorting equipment 86 that separates the material into fines and larger particles. A fines conveyor 88 is positioned to receive the fines as they are sorted, and similarly a coarse particle conveyor 90 collects the coarser material flowing over the sorting equipment 86. The two conveyors 88 and 90 are fitted with control gates 92 and 94, respectively, which are positioned over the collection hopper 96 of an inclined feed conveyor 98 that leads from the sorting equipment 86 upwardly to an airlock 100 mounted atop an entrainment unit 102.

The entrainment unit 102 is mounted on the inlet end of a shredder 104 that is carried on the vertical frame 44 above the outer inlet housing 46, and which is operated by a motor 106. The entrainment unit 102 includes a slotted portion 108 enclosed by an annular manifold 110, which is connected with the inlet housing 46 by a bleed conduit 112 that serves to bleed hot gas flow from the inlet housing 46 and supply it to the entrainment unit. The outlet of the shredder 104 is connected to one end of a supply conduit 114 that passes through the outer inlet housing 46 and connects with the inner inlet housing 48, at a point between the control dampers 60 and the inner chamber 28.

Raw bagasse is provided to the outer inlet housing 46 by a raw bagasse conveyor 116, which dumps the material into an airlock 118 mounted on top of a main supply conduit 120 that connects to the outer inlet housing 46 close to the annular chamber 24.

In operation, the conduit 58 is connected with a source of hot gas flow which, as has been noted, will normally be the exhaust gases taken from the flue of the sugar factory's boilers. The flow of gas into the outer inlet housing 46 is divided into three parts. The first and major part flows into the annular chamber 24, to effect primary drying of the raw bagasse. A second portion enters the inner inlet housing 48 through the dampers 60, the dampers being set according to the temperature and velocity of the gas flow to obtain the desired drying temperature within the inner chamber 28. A small third portion of the gas flow is bled off through the bleed conduit 112, and entrains the primary dried bagasse portion that is being supplied to the shredder 104 to help it move through the shredder and to help maintain its temperature.

Figure 2:
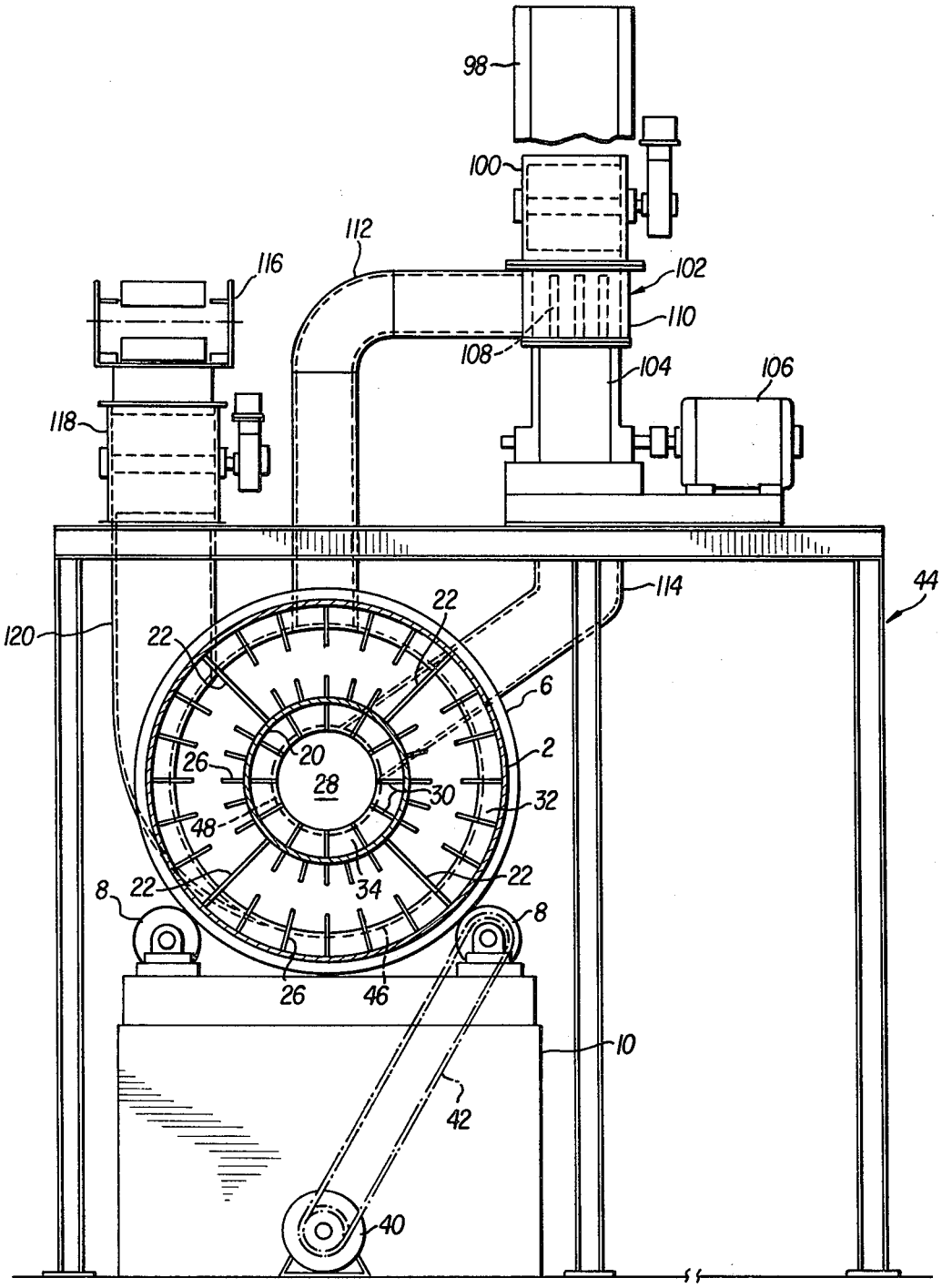
FIG. 2 is an enlarged, cross-sectional view taken generally on the line 2—2 in FIG. 1.

With the gas flow established and the drying drums 2 and 20 rotating, raw bagasse is then fed unto the operating conveyor 116 and drops into the rotating air lock 118, which allows entry of the raw bagasse into the outer inlet housing 46 without incurring loss of heated gas therefrom. Referring to FIG. 2, it will be noted that the conduit 120 is tangential to the cylindrical outer inlet housing 46, which facilitates feeding the raw bagasse into the annular chamber 24. As the raw bagasse enters the outer inlet housing 46 from the supply conduit 120, it is entrained by the gas flow and carried into and through the rotating outer chamber 24, the fins 26 serving to agitate the bagasse and help keep it moving. Passage of the raw bagasse through the annular chamber 24 effects primary drying thereof, and the primary dried bagasse is collected by the collector unit 62. As has been noted, a portion of the primary bagasse is drawn off into the hopper 82, while the main body thereof is moved out of the collector unit 62 and transferred away from the dryer apparatus. The primary dried bagasse can then be utilized for fuel directly, or for other suitable purposes.

As the screening or sorting unit 86 is operated to sort the primary bagasse material collected in the hopper 82 and discharged through the airlock 84, the control gates 92 and 94 are operated to admit a correctly blended flow of fine and coarse material into the hopper 96. The separated primary bagasse portion is then elevated to the air lock 100, which admits it to the entrainment unit 102, where it is mixed with hot gas flow from the conduit 58 and then enters the shredder 104. The shredder 104 is chosen to assure that the secondary dried bagasse will have the correct particle size necessary for pelletizing.

From the shredder 104, the primary bagasse enters the inner chamber 28, and is moved therethrough by gas flow entering through the dampers 60. The dampers 60 are set to effect the desired degree of drying in the chamber 28, to produce secondary dried bagasse with the desired characteristics. The conduit 74 takes the secondary dried bagasse from the outlet end of the inner chamber 28, and it is then transported to a processing location.

Among the features of the apparatus just described are several that contribute to maximum usage of the drying energy found in the hot exhaust gas flow which, as has been mentioned, will normally have a temperature of between about 375° and 425° F. A first feature is that the portion of the primary bagasse subjected to secondary drying is taken immediately from the hopper 82 while it is still hot, and is quickly conveyed over a short path to the entrainment unit 102, where it is immediately subjected to heated gas flow. Thus, the temperature of the primary bagasse portion selected for secondary treatment is maintained high, which contributes to the effectiveness of the secondary drying operation.

A second important feature is that the temperature within the annular chamber 24 is maintained relatively high because of the direct gas flow from the conduit 58, through the inlet housing 46, and into the annular chamber. Also, because the inner drying drum 20 constitutes the inner wall of the annular chamber 24 and is itself heated by the flow of hot exhaust gases therethrough, an efficient drying environment is established in the annular chamber.

Further, because the inner drying drum 20 is surrounded and insulated by the outer drying drum 2, the loss of heat from the inner chamber 28 is minimized. The flow of hot exhaust gases enters the inner chamber 28 with essentially the same ease as it enters the outer chamber 24, with no significant loss of heat because of lengthy transit. At the same time, the dampers 60 allow the rate of gas flow in the chamber 28 to be adjusted to achieve a desired degree of drying. Thus, the concentric chambers 24 and 28 are mutually reinforcing, and the two chambers cooperate to assure maximum energy efficiency in utilizing the hot flue gases.

Another feature derived from the apparatus is its compactness and mechanical simplicity, as compared to the separate dryer arrangements utilized for bagasse in the past. Obviously, the invention also includes a number of other operational advantages.

Turning now to the present method, it is seen that such includes the following steps:

1. Effecting primary drying of raw bagasse by passing it through an annular chamber connected directly with a source of hot exhaust gases, the hot gases being effective to move the raw bagasse through the chamber and to remove moisture therefrom, and the walls defining the annular chamber being rotated about a horizontal axis to agitate the raw bagasse;
2. Collecting the primary dried bagasse at the outlet of the annular chamber;
3. Dividing a portion of the primary dried bagasse from the rest as it is collected;
4. Immediately conveying the divided portion of primary dried bagasse into a cylindrical inner chamber disposed concentrically within said annular chamber, the inner chamber being directly connected with the same source of hot exhaust gases and the portion of bagasse being moved through said cylindrical chamber and having moisture removed therefrom by the flow of said gases, the wall defining said inner chamber also being rotated about said horizontal axis; and
5. Collecting the secondary dried bagasse from the cylindrical chamber, the flow of hot gases into said cylindrical chamber being regulated to effect the desired degree of moisture removal from the secondary bagasse.

In the invention, the primary drying step is effective to reduce moisture in the raw bagasse as it comes from the mill from a level of about 50% to a more acceptable level of from 35%–40%. The secondary drying of a portion of the primary dried bagasse according to the present method can lower the moisture content in the secondary dried bagasse to about 12%.

For a typical installation, the inner diameter of the outer drying drum 2 might be about 14 feet, and that of the inner drum 20 about 5–6 feet. Overall length of the chambers 24 and 28 would be from 18–20 feet.

In a typical example of the method, a sugar mill would provide about 60 tons of bagasse per hour, and the factory boiler would exhaust approximately 185,000 CFM of exhaust gas at about 400° F. All of the raw bagasse, having a moisture content of about 50%, would be passed through the outer annular chamber 24 of the dryer for primary drying, utilizing about 150,000 CFM of the hot exhaust gas. Segregation of a portion of the primary dried bagasse would then occur, and the balance of the primary bagasse would typically be transported to the boiler for use directly as fuel.

The segregated portion would then be passed through the inner chamber 28 to effect secondary drying thereof, utilizing about 35,000 CFM of the exhaust gases, which would produce secondary dried bagasse with a moisture content of about 12%. The secondary dried bagasse would then be taken to the pellet mill for pelletizing.

Segregation of a portion of the primary bagasse can be done pneumatically, by screening, or by any other conventional operation. The fines are primarily wanted for secondary drying, while the larger and coarser material is simply burned as fuel as in the past. It should also be noted that while a shredder will normally be utilized on the segregated bagasse before it enters the inner chamber 28 for secondary drying, in some instances it may not actually be needed. The condition of sugar cane stalk can vary from time to time and field to field, and the process is adjusted to take these variations into account.

It is to be understood that the mechanical details of the apparatus can be varied without departing from the invention. For example, the shape and placement of the agitating fins can be changed from what is shown herein, and the rotating seals can be constructed differently, without departing from the invention.

Obviously, many modifications and variations of the invention are possible.

We claim:

1. A drying method for producing primary and secondary dried bagasse from raw bagasse, comprising the steps of:

passing the raw bagasse through an annular chamber connected directly with a source of flowing hot exhaust gases, the flowing hot gases being effective to move the raw bagasse through the annular chamber and to remove moisture therefrom to produce primary dried bagasse, and the walls defining the annular chamber being rotated about a horizontal axis to agitate the raw bagasse during its passage through the chamber;

collecting the primary dried bagasse at the outlet end of the annular chamber;

dividing a portion of the primary dried bagasse from the remainder thereof, as it is collected;

conveying the divided portion of primary dried bagasse into a cylindrical inner chamber disposed concentrically within said annular chamber and connected with the same source of flowing hot exhaust gases as said annular chamber, said divided portion being moved through said inner chamber and being dried by said flowing hot gases to produce secondary dried bagasse, and the wall defining said inner chamber also being rotated about said horizontal axis; and collecting the secondary dried bagasse from the outlet end of said cylindrical chamber.

2. The method as recited in claim 1, wherein said hot exhaust gases have a temperature of between about 375° and 425° F.

3. The method as recited in claim 1, wherein said step of conveying said divided portion of primary dried bagasse is done immediately, and includes the steps of:

passing said divided portion to an entrainment unit, where it is entrained by hot exhaust gases taken from said source; and then passing said entrained divided portion through a shredder before entry thereof into said cylindrical inner chamber.

4. Apparatus for drying raw bagasse to produce primary and secondary dried bagasse, including:

a source of hot exhaust gases;

a first, generally horizontally disposed drum mounted for rotation about its longitudinal axis;

means for effecting rotation of said first drum;

a second drum mounted concentrically within said first drum for rotation therewith and spaced therefrom to form an annular outer chamber therebetween, said drums being generally coextensive and the interior of said second drum forming an inner chamber, and said chambers having inlet and outlet ends;

housing means connecting the inlet ends of said chambers with said source of hot exhaust gases, and arranged so that a first portion of said hot gases flows through said annular outer chamber and a second portion thereof flows through said inner chamber, said housing means including means for regulating the flow of said second gas portion through said inner chamber;

means arranged to feed raw bagasse to the inlet end of said annular outer chamber, said first portion of said hot exhaust gases being effective to move said raw bagasse through said rotating annular outer chamber and to effect primary drying thereof to produce primary dried bagasse;

collector means arranged at the outlet end of said annular outer chamber for collecting primary dried bagasse, and including means for dividing a portion of said primary dried bagasse from the remainder thereof;

conveyor means arranged for collecting said divided portion of said primary dried bagasse and conveying it to said inlet end of said inner chamber, said divided portion being moved by said second portion of said hot exhaust gases through said inner chamber and being dried thereby to produce secondary dried bagasse; and conduit means connected with the outlet end of said inner chamber, for collecting said secondary dried bagasse therefrom.

5. Apparatus as recited in claim 4, wherein said housing means includes:

an outer housing connected with said source of hot exhaust gases, and having an outlet end provided with rotatable joint means thereon;

an inner housing mounted within said outer housing and having an inlet end open to said outer housing for receiving hot exhaust gases therefrom, and an outlet end having rotatable joint means thereon;

said outlet ends of said outer and said inner housings abutting the inlet ends of said first drum and said second drum, and said inlet ends of said first and second drums carrying rotatable joint means thereon arranged to cooperatively engage said rotatable joint means on said outer and inner housing outlet ends, respectively.

6. Apparatus as recited in claim 5, wherein said inlet end of said inner housing has adjustable dampers mounted thereacross, to control the flow of gases therethrough.

7. Apparatus as recited in claim 4, wherein said conveyor means includes:

an entrainment unit mounted atop said housing means, and connected with said inner chamber;

a bleed conduit connected between said housing means and said entrainment unit, and adapted to conduct a portion of said hot exhaust gases from said housing means to said entrainment unit; and a conveyor extending from said collector means to said entrainment unit, arranged to convey said divided portion of said primary dried bagasse thereto.

8. Apparatus as recited in claim 6, wherein said conveyor means further includes:

a shredder mounted between said entrainment unit and said inner chamber.

9. Apparatus as recited in claim 4, wherein the walls defining said inner and said outer chambers carry fins thereon, arranged to agitate the bagasse as said drums are rotated.

10. Apparatus as recited in claim 4, wherein said means arranged to feed raw bagasse to the inlet of said annular outer chamber and said conveyor means for conveying the divided portion of said primary dried bagasse to the inlet of said inner chamber each have airlock means incorporated therein, arranged to prevent the leakage of hot exhaust gases from said housing means.

* * * * *